United States Patent [19]

Rhodes et al.

[11] 4,342,246

[45] Aug. 3, 1982

[54] MULTIPLE VOICE ELECTRIC PIANO AND METHOD

[75] Inventors: Harold B. Rhodes, La Habra; James B. Murphy, Costa Mesa, both of Calif.

[73] Assignee: CBS Inc., New York, N.Y.

[21] Appl. No.: 162,487

[22] Filed: Jun. 24, 1980

[51] Int. Cl.[3] ..... G10H 3/00

[52] U.S. Cl. ..... 84/1.04; 84/1.22; 84/1.26

[58] Field of Search ..... 84/1.04, 1.19, 1.22, 84/1.26, 1.01

[56] References Cited

U.S. PATENT DOCUMENTS

| | | | |
|---|---|---|---|
| Re. 27,015 | 12/1970 | Dijksterhuis et al. | 84/1.26 |
| 1,992,438 | 2/1935 | Miessner | 84/1.01 |
| 2,561,349 | 7/1951 | Earp | 84/1.14 |
| 2,625,659 | 1/1953 | Mendelson . | |
| 2,641,753 | 6/1953 | Oliwa | 340/345 |
| 3,000,252 | 9/1961 | Wayne | 84/1.01 |
| 3,160,694 | 12/1964 | Meinema | 84/1.12 |
| 3,248,470 | 4/1966 | Markowitz et al. | 84/1.1 |
| 3,267,196 | 8/1966 | Welsh et al. | 84/1.18 |
| 3,306,969 | 2/1967 | Barber | 84/1.24 |
| 3,374,316 | 3/1968 | Slaats . | |
| 3,429,976 | 2/1969 | Tomcik | 84/1.12 |
| 3,444,306 | 5/1969 | Peterson | 84/1.13 |
| 3,445,579 | 5/1969 | Markowitz et al. | 84/1.24 |
| 3,476,863 | 11/1969 | Campbell | 84/1.01 |
| 3,510,565 | 5/1970 | Morez | 84/1.06 |
| 3,514,522 | 5/1970 | Mussulman | 84/1.18 |
| 3,588,310 | 6/1971 | Gschwandtner | 84/1.13 |
| 3,629,484 | 12/1971 | Suzuki | 84/1.25 |
| 3,637,913 | 1/1972 | Evans | 84/1.01 |
| 3,644,656 | 2/1972 | Fender et al. | 84/1.04 |
| 3,651,242 | 3/1972 | Evans | 84/1.11 |
| 3,659,032 | 4/1972 | May | 84/1.04 |
| 3,711,617 | 1/1973 | Evans | 84/1.01 |
| 3,746,774 | 7/1973 | Adachi | 84/1.24 |
| 3,748,367 | 7/1973 | Lamme et al. | 84/1.04 |
| 3,886,834 | 6/1975 | Okamoto | 84/1.24 |
| 3,911,776 | 10/1975 | Beigel | 84/1.24 |
| 3,973,461 | 8/1976 | Jahns | 84/1.11 |
| 4,161,128 | 7/1979 | Yamada et al. | 84/1.26 |
| 4,195,544 | 4/1980 | Koike | 84/1.24 |
| 4,202,237 | 5/1980 | Håkansson | 84/1.24 |

FOREIGN PATENT DOCUMENTS

| | | |
|---|---|---|
| 703733 | 2/1954 | United Kingdom . |
| 1042057 | 9/1966 | United Kingdom . |
| 1537170 | 12/1978 | United Kingdom . |

*Primary Examiner*—J. V. Truhe
*Assistant Examiner*—Forester W. Isen
*Attorney, Agent, or Firm*—Gausewitz, Carr, Rothenberg & Edwards

[57] ABSTRACT

An electric piano has a complete player actuated piano voice of which harmonics are basically controlled by a tuning fork that is struck by the piano key. The piano is also provided with an electronically generated voice of which harmonics are electronically generated. To better enable the two voices to be played simultaneously by striking a single piano key, the amplitude envelope of the electromechanically generated piano voice is imposed upon the electronically generated voice which is gated and amplitude modulated so as to be heard in precise synchronization with a piano note produced by the instrument player. Linearity of modulation is extended to low piano voice amplitudes by use of modulating and gating diodes in oppositely poled feedback paths of an operational amplifier.

21 Claims, 3 Drawing Figures

MULTIPLE VOICE ELECTRIC PIANO AND METHOD

BACKGROUND OF THE INVENTION

Organ and piano type electrical musical instruments are analogous in use of keyboard operation but have widely different touch dynamics and harmonic content. In the electronic organ type instrument, a key operated switch calls forth one or more voices generated electronically by an electronic oscillator and electrical dividing circuits or by digital arrangements that may use recorded wave forms and repetitive digital readout. Selected notes and/or voices are provided by operator actuation of the keyboard which controls electrical switches that send one or more electronically generated voices to a loudspeaker.

In the most popular electric pianos, a keyboard is provided in which actuation of each key mechanically causes vibration of a reed or tine, which vibration is transduced by a suitable pickup device into an electrical signal and then amplified and converted to sound.

The electronically generated voice and the piano voice each have unique characteristics finding favor with players and listeners. The electromechanical generation of the piano voice, by physically vibrating a reed or tine, provides touch dynamics in the resulting sound, creating an amplitude envelope having attack and decay characteristics uniquely defined in part by mechanical and magnetic configuration of the keyboard and transducer, and in part by the musician. Such touch dynamics are absent from the usual electronically generated voices of the organ type instrument. To provide the pure electronic voices of the organ type instrument with a pianolike sound, various attempts have been made to impose a synthesized amplitude envelope upon the electronically generated voices. Such amplitude envelopes have been partially simulated by various electrical circuits. Others have provided a vibratory reed associated with the tone key and electric circuits to impart amplitude characteristics of the reed to the electronic tone source of an electric organ. These are merely modulated organ voices having no true electric piano sound, nor do they provide satisfactory touch dynamics.

In prior electrical instruments, where a selected amplitude envelope is impressed upon an electronically generated voice, modulating circuits of lesser accuracy, precision and linearity have been employed. Such modulators employ diode circuits of which the linearity is limited at low amplitudes by conduction thresholds of the diodes. Although the amplitude envelope of such a modulator may be such as to provide a very soft or low amplitude sound, the typical diode, because of its conduction threshold, will often provide a sharp cutoff at low amplitude, thus severely compromising desired linearity of such a modulator over the necessary wide range of loudness and providing a sound that is undesirable in many situations.

Accordingly, it is an object of the present invention to provide a new type of keyboard instrument in which both electric piano and electronic voices can be and usually are played together, with extended linearity of modulation. A further object is to permit the piano voice to be generated separately when desired, without any hum or other harmful effect.

SUMMARY OF THE INVENTION

In carrying out principles of the present invention, in accordance with a preferred embodiment thereof, a multi-voice electric piano and method employs a player operated keyboard for percussively generating an electric piano voice and has an electronic arrangement for generating an electronic voice. The electronic voice is amplitude modulated by the piano voice over a wide linear amplitude range and the modulated electronic voice is combined with the piano voice so that the two may be heard simultaneously by the pressing of a single key. According to one feature of the present invention the modulator uses an operational amplifier to control differential combination of modulating and modulated signals and operation of the modulator diodes. Very importantly, the circuits are such that the pure electromagnetically generated piano voice comes through, without noise, hum, etc., when it is not desired to use the electronic voice.

DETAILED DESCRIPTION

Figure 1:
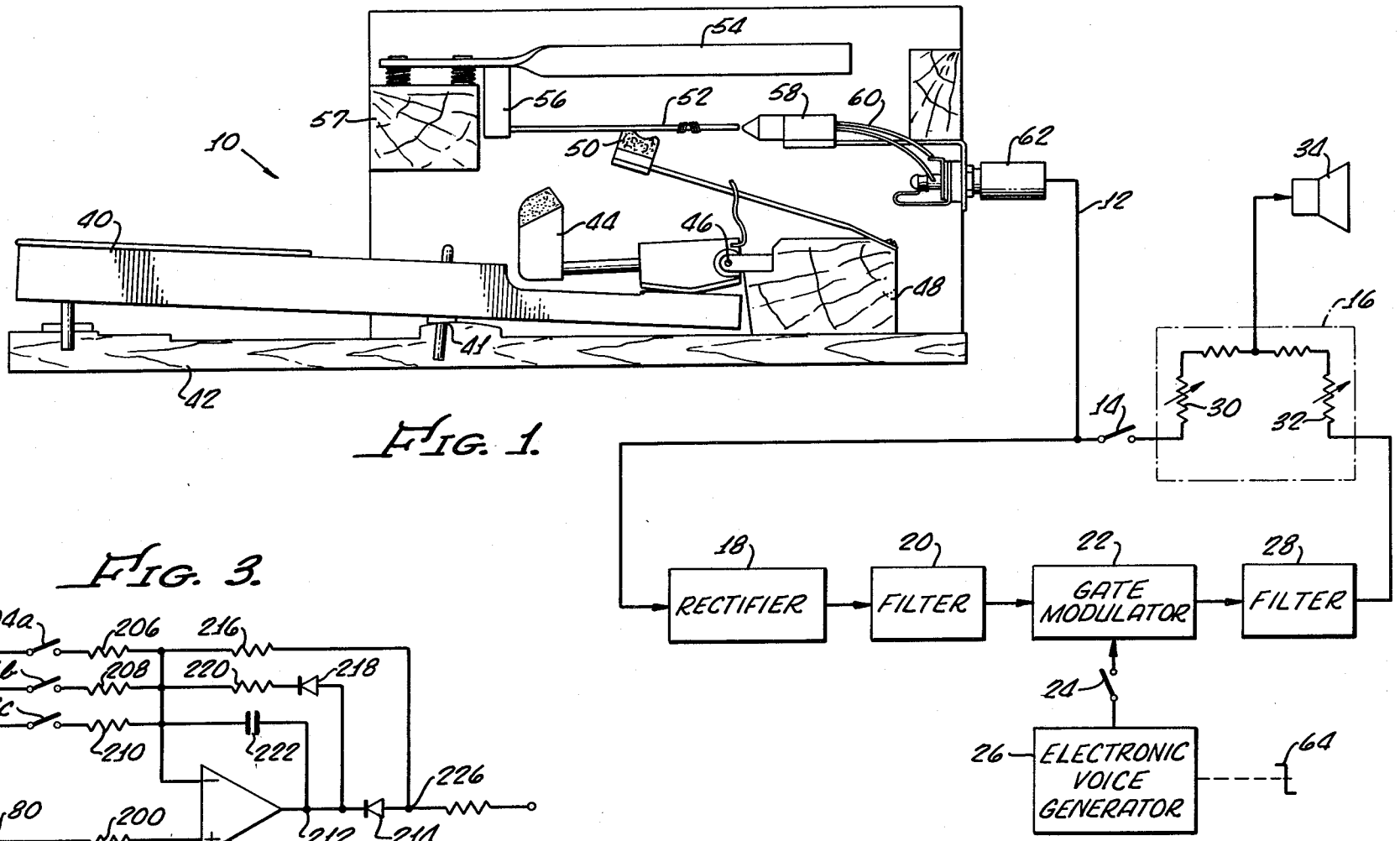
FIG. 1 is an electrical block diagram, also showing mechanical parts of a multi-voiced piano embodying principles of the present invention.

Illustrated in FIG. 1 is an arrangement for generating a single tone or note of a multi-voiced piano embodying principles of the present invention. The generation of this single note will produce either a pure electromechanically generated piano voice with unique touch dynamics, or an electronically generated electronic voice having the same touch dynamics, or, as its primary operation, the simultaneous sound of the piano voice and the electronic voice, both with the same touch dynamics. Except for the speaker of FIG. 1, the components, both mechanical and electrical, shown in this figure are duplicated for each key of the instrument. Thus, for a piano with 88 keys, there are 88 arrangements identical except for frequency to the arrangement shown in FIG. 1. It will be readily appreciated, nevertheless, that for the electronic voice generator, parts may be used in common for provision of different octaves (as by a master tone generator and dividing circuits, for example) so that complete duplication of all aspects of the electronic voice generator is not necessary.

The arrangement illustrated in FIG. 1 comprises a player operated keyboard and mechanical or vibratory tone generator, generally indicated at 10, that produces a piano voice electrical signal on an output lead 12 which is fed via a switch 14 to a mixer 16. A piano voice on line 12 is also fed to a rectifier 18 which produces a signal directly corresponding to the amplitude envelope of the piano voice on line 12. This envelope is then filtered in a filter 20 and fed to a gate/modulator 22 which receives as a second input an electronic voice provided via a switch 24 from an electronic voice generator 26. The output of the modulator is fed to additional filtering circuits 28, thence as a second input to the mixer 16 which may be provided with additional filtering, wave shaping and attenuating circuits schematically represented by variable attenuating resistors 30 and 32. The signals fed to the mixer 16, after shaping, filtering and attenuation as selected, are converted to sound by a loudspeaker 34.

It will be readily appreciated that various types of keyboards and piano-type arrangements of an electrical piano may be employed in the practice of the present invention. Each will have its own unique touch characteristics, quite unlike an organ. Tone and touch dynamics of an electric piano keyboard arrangement of the type shown in U.S. Pat. No. 3,644,656, and particularly of the type shown in a pending U.S. patent application of H. L. Absmann filed Dec. 12, 1977, Ser. No. 859,918, for Keyboard Construction For Pianos, are presently preferred for use with the multiple voice piano of the present invention. An action of U.S. Pat. No. 3,644,656 is illustrated in FIG. 1, primarily for purposes of exposition. The single piano action shown in elevation in FIG. 1 creates a single electromagnetically generated piano note by an arrangement including a piano key 40 pivotally mounted at fulcrum 41 on a lower support element 42 and arranged to drive a hammer 44 pivoted at 46 to a cross support 48 and also arranged to momentarily retract a damper 50. The hammer strikes a relatively low mass reed or tine 52 that constitutes one vibratory element of an asymmetrical tuning fork which also includes a relatively high mass twisted tone bar 54. Both the low mass tine 52 and the high mass twisted bar 54 are fixedly secured to each other by being cantilevered from a common base 56 that is resiliently mounted to a cross support 57.

A mechanical to electric transducer 58 is adjustably mounted adjacent the free end of tine 52 and electromagnetically responds to vibration of the tine by producing on leads 60 an electrical signal that is fed via a jack 62 to the piano voice output line 12. Thus, striking of the key 40 causes vibration of the tuning fork and generation of an electrical signal having a frequency and an harmonic content determined by the asymmetrical tuning fork 52, 54, 56. Further details of this piano keyboard are shown in U.S. Pat. No. 3,644,656.

One particular type of electric piano keyboard and piano voice tone generation have been described, by way of example. Other types of vibratory tine tone generators may be employed to provide upon lead 12 a piano voice that may be fed, with suitable amplification, to provide a piano sound via loudspeaker 34.

The illustrated arrangement provides a first and true electromechanically generated piano voice for the illustrated instrument. A second voice for this instrument is generated independently of generation of the piano voice, but is passed to the loudspeaker under control of the piano voice and in precise extended linear range synchronization therewith. The arrangement is such that, with both switches 14 and 24 closed to pass the respective piano and electronic voices to the mixer 16, striking the single key 40 will feed both voices to mixer 16 whereby speaker 34 will convert the combined piano and electronic voices to sound, as will be more particularly described in connection with FIG. 2. The continuously generated electronic voice is both gated and amplitude modulated by the piano voice. It is gated by the piano voice so that the electronic voice is passed to the mixer only when a piano voice signal exists on line 12. The electronic voice is modulated by causing the amplitude envelope of the electronic voice to precisely follow the amplitude envelope of the piano voice. This modulation retains the piano touch dynamics for the electronic voice.

It may be noted that in this arrangement, wherein the striking of a single piano key can generate two mutually synchronized voices, the piano voice and the electronic voice, it is desired to provide a direct or one-to-one relation between loudness of the piano signal provided from transducer 58 and loudness of the mixer output. Particular problems are encounterd in linearly matching electronic voice amplitude and piano voice amplitude at low amplitudes of vibration of the tuning fork, amplitudes so low that the piano voice signal on line 12 may be in the order of 0.001 volts or less. Further, the desired precision of linearity must be provided over a range in the order of ten thousand to one, or about 80 db.

In the described arrangement, where striking a single key calls up two separate voices for mixing and simultaneous playing through the loudspeaker, it is essential for good sound, that the two voices be precisely synchronized and that their amplitude envelopes be the same. In prior diode modulators which may have a conducting threshold voltage of as much as 0.5 volt, this threshold becomes a major fraction of the maximum amplitude of the signal, where such amplitude is in the order of 14 volts, for example. The use of such a prior diode modulator arrangement in the described multi-voice keyboard instrument would cause the electronic voice to drop suddenly at low piano voice amplitudes, and thus the electronic voice would cease before the piano voice. Further, this difference in duration, with the use of such prior modulator, would vary according to the loudness of the note being played.

With the use of the gate modulator described below, the effects of the diode conduction threshold are made so small as to be negligible and thus the electronic voice is much more precisely and more linearly synchronized with the piano voice. Accordingly, when a key is struck the two voices are converted to sound through the loudspeaker with the electronic voice envelope being an identical copy of the piano voice envelope whereby the sound provided by the pressing of a single key appears to have been provided by the generation of two notes simultaneously. The electronic voice thus may add its unique and rich harmmonic content to the piano voice.

The fundamental frequency of the electronic voice generator 26 need not be the same as the fundamental frequency of the tuning fork of the piano note with which the electronic voice is associated, but may be any randomly chosen frequency. However, when the electronic voice generator is chosen to have a fundamental that is related to the fundamental of the piano voice with which it is associated, by a conventional musical interval, such as a third or a fifth, the striking of the single key will provide the sound of a chord or a pair of notes simultaneously played on the piano. The electronic voice generator is separately tunable by a tuning control knob 64 to vary its fundamental frequency as desired. Harmonic content can also be varied as will be described below.

Figure 2:
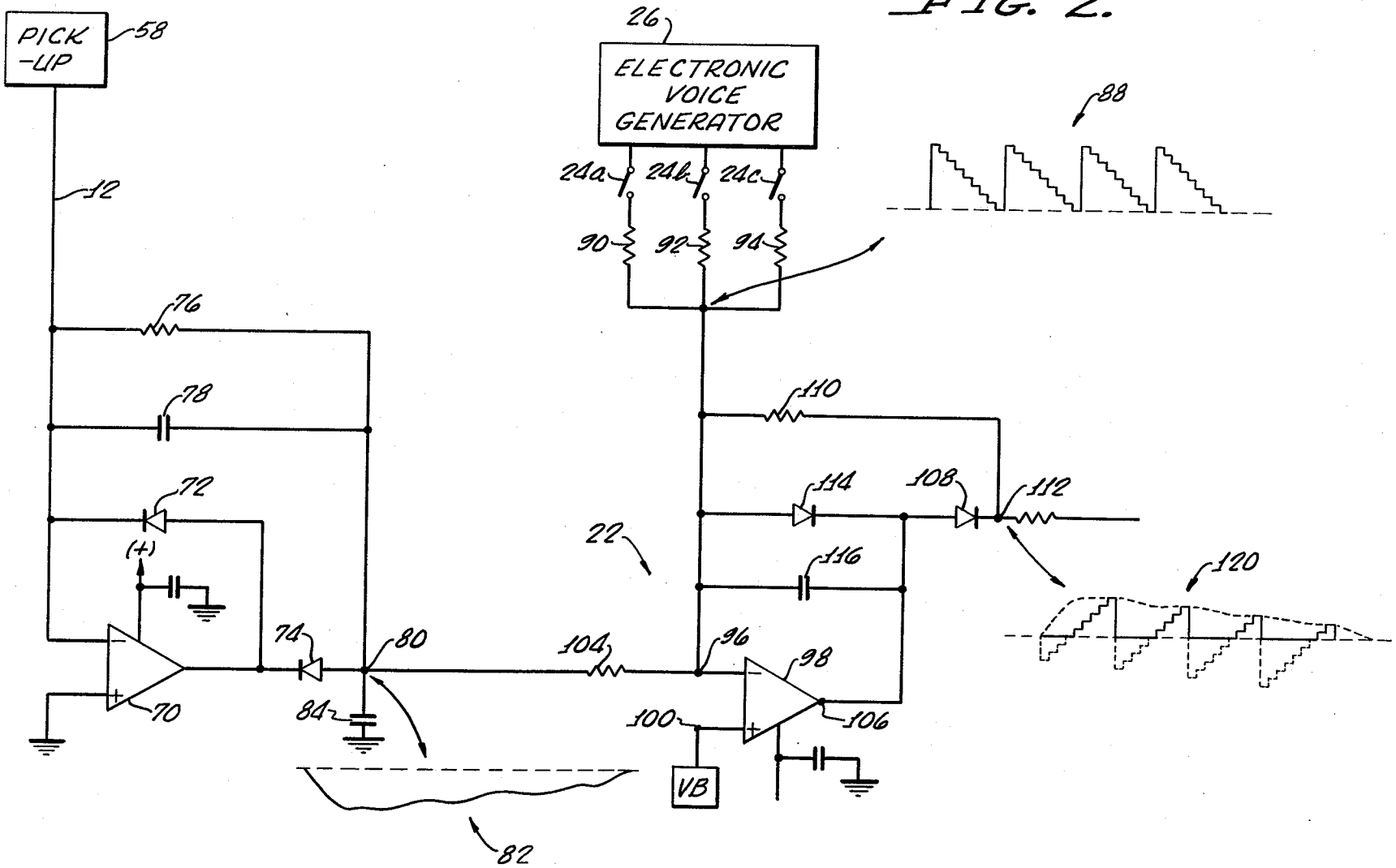
FIG. 2 is a circuit diagram of a presently preferred detector and gate/modulator employed in the piano of FIG. 1.

As illustrated in FIG. 2, the electromechanical tone signal generated by the tuning fork and transducer or pick-up 58 is fed via lead 12 to a rectifier filter circuit which comprises an operational amplifier 70 having a grounded non-inverting input (designated by +), the tone signal being fed to the inverting input (designated by −) of the amplifier. Feedback from the amplifier output is provided in two paths, via a diode 72, and via a series connected diode 74 and parallel combination of resistor 76 and a capacitor 78. Positive going portions of the piano voice signal on lead 12, fed to the inverting input of the amplifier, are inverted and passed by output diode 74 to a rectifier output terminal 80 to which is connected a filter capacitor 84. Negative going portions of the piano voice signal are blocked by diode 74. Thus, at rectifier output terminal 80 appears a control signal 82 in the form of the negative amplitude envelope of the piano voice, having the unique amplitude envelope of the piano including attack and decay characteristics.

The electronic voice generator 26 may be any one of a number of different types of known electronic tone generators. Presently preferred is a substantially conventional staircase type of tone generation in which three square waves, a fundamental, a second harmonic and a fourth harmonic are combined to provide an electronic signal having a chosen harmonic content, as illustrated by the current wave form 88 in FIG. 2.

Signal 88 and control signal 82 are fed to the gate/-modulator 22. The modulator uses a very high gain operational amplifier to control differential combination of signals 82 and 88 and to control operation of its diodes.

Three positive square waves that collectively form this electronically generated staircase voice are fed via individually and independently operated switches 24a, 25b and 24c and respective resistors 90, 92 and 94 to the inverting input 96 of the modulator operational amplifier 98 that has a non-inverting input 100 connected to a source VB of relatively small negative voltage such as −8.4 millivolts, for example. The control signal 82 at the rectifier output terminal 80 is also fed to the amplifier inverting input 96 via a resistor 104. Thus, the amplifier inverting input 96 receives the positive electronic voice signal 88 and also receives the negative control signal, the amplitude envelope signal 82, which varies between ground and a negative value such as −15 volts, for example. The generated staircase signal components, when combined, would vary between ground and +15 volts, although the action of the amplifier maintains the signal at input 96 substantially at zero, or equal to the very small fixed voltage at input 100.

The output terminal 106 of amplifier 98 is connected to its inverting input 96 via three different feedback paths. A first feedback path includes a diode 108 connected at point 112 in series with a resistor 110 which has its other end connected to the amplifier input 96. It is the junction 112 of the series connection between diode 108 and resistor 110 that forms the output of the gate/modulator 22.

A second feedback path is provided by a second diode 114, which is poled oppositely with respect to the diode 108 and connected in a low resistance path directly between the output of the amplifier and its inverting input. A third feedback path, via a small capacitor 116 is provided to bypass the very high frequency components of the electronic staircase signal so that these do not appear as transient spikes at the output of the modulator where they might cause an undesirable signal component.

In a presently preferred embodiment both operational amplifiers 70 and 98 are either National Semi-Conductor LF353 or Texas Instruments TL082 Dual J-FET Input Operational Amplifier integrated circuits, although other operational amplifiers may be employed.

MODULATOR OPERATION

When no note is played and no key has been struck, the control voltage at point 80 is zero. The continuously generated electronic voice provides a positive signal to amplifier input 96 which in turn provides a negative signal at output 106. This negative signal reverse biases diode 108 so that no signal is fed to the modulator output terminal 112. The negative signal at amplifier output 106 instead is passed through the correspondingly (negatively) poled feedback path including negatively poled diode 114. This feedback path is provided with no resistance other than that of the voltage drop across the forwardly conducting diode. Because of the extremely high gain of this high gain amplifier, if the feedback path for the electronic voice, the path including diode 114, had a greater resistance, that signal component at amplifier output 106 which is caused by the electronic voice would have a considerably higher magnitude, a magnitude sufficient to transmit an undesired signal to modulator output 112 through the capacitance of the diode 108. However, because there is very little resistance in the feedback path including diode 114, the staircase signal input to this very high gain amplifier, in the absence of a control signal, produces a signal of negligible magnitude at point 106 and thus no audible level signal is passed to the modulator output.

When a key is struck, the piano voice is fed directly to mixer 16 via switch 14 (FIG. 1) and also fed via lead 12 to the rectifier/filter 18,20 at the output 80 of which appears the negative control signal envelope 82. During the relatively small percentage of the period of the electronic voice in which the electronic voice amplitude is zero, the control signal, which is passed to the amplifier inverting input via resistor 104, provides a positive signal at amplifier output 106 to forward bias output diode 108 and thereby produce a signal at modulator output 112. The amplified control signal is fed from the amplifier output at point 106 through the positively poled feedback path including positively poled diode 108 and series connected resistor 110, the latter preferably being of a value equal to the value of resistor 104 through which the control signal is applied to the amplifier. With resistors 104 and 110 equal to each other, and with the electronic voice signal at zero volts, the modulator output at point 112 is a positive value equal to the negative value of the control signal 82.

As the electronic voice signal goes positive from its short term zero level and becomes equal to or greater in magnitude than the negative magnitude of the control signal, assuming the two are simultaneously applied to the inverting input 96, the amplifier output 106 goes to zero or below zero, since the two signals at point 96 are differentially combined. However, no negative signal can pass through the diode 108 and thus positive values of the electronic voice that are greater in amplitude than the negative values of the simultaneously existing control signal are clipped by the circuit including diode 108.

Now, as the electronic voice signal begins to decrease from its high positive value to a positive magnitude less than the simultaneously occurring negative magnitude of the control signal, the amplitude of the output signal at amplifier 106 begins to go more positive and this positive signal is transmitted through the diode 108 to the modulator output 112. Thus, there is provided at the modulator output 112 the modulated electronic voice signal 120, which is a clipped version of the electronic staircase voice signal 88 (clipped or blocked portions of signal 88 being shown in dotted lines below the horizontal line in the heuristic illustration of the modulated signal 120). The modulated signal has an amplitude envelope (also shown in dotted lines) that varies according to the amplitude envelope of the modulating control signal 82.

To avoid passage of stray signals through diode 108 that may occur in the absence of a control signal 82, diode 108 is provided with a small reverse bias by means of a negative signal fed to the non-inverting input 100 of the amplifier. This small negative signal provides a negative signal at amplifier output 106 that reverse biases diode 108. The reverse bias on diode 108 is small because of the very low (almost negligible) resistance in the feedback path that includes diode 114 and because the operational amplifier tends to maintain the signal at its inverting input nearly equal (in magnitude) to the signal at its non-inverting input. However, the gain of the operational amplifier is so high that this biasing signal and also the conductive thresholds of the modulating diodes provide a substantially negligible effect upon linearity of the modulator. Accordingly, even with exceedingly small amplitude of the control signal a corresponding small amplitude of electronic voice is provided at the modulator output. There is provided the desired one-to-one relation between the control signal amplitude and the modulator output (by means of equality of resistors 104 and 110) and the effect of the forward voltage drops of the gating and modulating diodes are immaterial because of the control exerted by the high gain operational amplifier. Furthermore, by providing the very low resistance feedback path including diode 114, the electronic voice is effectively prevented from passing through the modulator in the absence of a control signal.

Figure 3:
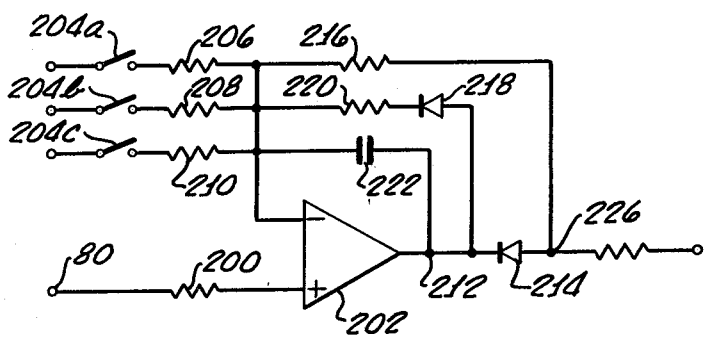
FIG. 3 shows a circuit of an alternative form of gate/-modulator.

A modified version of the gate modulator 22 is illustrated in FIG. 3 wherein the piano voice envelope control signal from rectifier filter output at point 80 is fed via a resistor 200 to the non-inverting input of an operational amplifier 202 having the continuously generated electronic staircase voice signal fed via switches 204*a*, 204*b*, 204*c* and resistors 206, 208 and 210, respectively, to the inverting input of the amplifier. Three feedback paths are again provided between the amplifier output 212 and its inverting input, the first by means of a series connected diode 214 and resistor 216, the second by means of a series connected but oppositely poled diode 218 and resistor 220, and the third via a capacitor 222.

In this arrangement, both the control signal and the staircase signal are fed to the amplifier inputs as negative signals, varying between zero and about 15 volts in each case. Differential combination of the two amplifier inputs is provided in this case by feeding the two input signals with the same polarity to different inputs, whereas differential combination is provided in the circuit of FIG. 2 by feeding the two signals with opposite polarities to the same input. Accordingly, diodes 214 and 218 are poled differently than in the case of the previously described modulator, but again, the feedback paths including the two diodes are oppositely poled relative to one another. The negative control signal at the non-inverting input is fed through the first feedback path including diode 214 and resistor 216 and appears at the modulator output 226. In the absence of a control signal, the negative staircase signal fed to the inverting input of the amplifier reverse biases diode 214 of the first feedback path and produces feedback through the second feedback path including the oppositely poled diode 218 and resistor 220. Operation is similar to that described in connection with the gate modulator 22 of FIG. 2 with some differences in result. The modulator output at point 226 is a negative going signal rather than a positive going signal and, because of the resistance 220 in the feedback path including diode 218, signal amplitude swings at point 212, at the output of the amplifier, that are caused by the negative staircase signal at the inverting input, are of considerably greater magnitude than in the previously described embodiment and therefore are subject to leakage through the inherent capacitance of the diode 214 which is reverse biased by the inverted staircase signal at the amplifier output 212. Partly for this reason the circuit of FIG. 2 is preferred.

When both the control and the staircase are provided, the modulator of FIG. 3 operates to cause the negative control signal component appearing at the amplifier output 212, to be diminished by the positive staircase signal component appearing at the same point. Accordingly, the modulator output at point 226 diminishes from the magnitude produced by the amplitude of the envelope control signal by an amount dependent upon the magnitude of the staircase signal, to thereby produce a negative amplitude modulated and gated staircase at the output 226.

It will be seen that the described modulators use clamping diodes in the feedback loops of an exceedingly high gain operational amplifier and thereby allow the clamping action to be independent of the characteristics of the diode. In modulators using diodes, or transistors operating as diodes, or operating in a cutoff sense, the clamping action becomes exceedingly nonlinear when the magnitude of the control voltage begins to approach the magnitude of the forward turn on voltage of the diode. The described modulators are precision clamps in which the threshold voltages of the diodes are essentially swamped out or overcome by the exceedingly high gain of the operational amplifier. Without this use of the operational amplifier with the clamping diodes in the multi-voice piano of this invention the quality of sound will be incorrect with a piano note that is played softly in that the harmonics of the sound contributed by the electronically generated voice will die away suddenly in relation to the piano voice. Further, when the note is struck with greater force, the electronic voice will continue for a longer time relative to the piano voice.

A significant feature, therefore, of this arrangement is the ability to preserve the mechanical touch dynamics of the original piano mechanism and piano voice and to apply these very same touch dynamics to the electronic voice. Therefore, instead of providing a sound of two different instruments in one case, the sound is that of the piano voice with additional harmonics contributed by the electronic voice and with such harmonics exactly rising and decaying with the original piano voice because of the precision gate modulator. The described arrangement provides a linearity of control range that is in the order of 75 to 80 db depending upon the quality of the operational amplifier. The linear range of control is from full loudness to a level at least 60 db below full loudness and typically within 75 to 80 db of range. In other words, the piano signal is accurately followed until it is 80 db weaker than it is at its maximum loudness.

For example, striking a piano key with great force will typically create a pick-up signal of about 100 to 200 millivolts and the piano voice circuit will accurately follow the amplitude of the vibrating tine until the pick-up coil output is 80 db less. At that point, the piano voice is barely audible. If one were to use a conventional diode clamp without the described circuit or equivalent, there would be useful signal over only about a 30 db range. In such a case, using a conventional clamp, striking the piano key with great force and after the piano voice had decayed about 30 db, the loudness of the piano and the loudness of the harmonics added by the electronic staircase would begin to diverge suddenly. Further, if the piano key is struck very softly it may be possible that the amplitude envelope of the piano voice would never reach a magnitude sufficient to produce any of the electronically generated harmonics of the modulator output.

It is also contemplated that each piano note may be associated with more than one electronically generated note so that the piano voice can be combined with one or any selected combination of different electronic voices. For use of two or more electronic voices with the piano voice, two or more modulators are provided, each being the same as modulator 22 and each receiving the piano envelope control signal and one of the electronic voices, with the outputs of all modulators suitable mixed and fed to the speaker.

The foregoing detailed description is to be clearly understood as given by way of illustration and example only, the spirit and scope of this invention being limited solely by the appended claims.

What is claimed is:

1. An electric piano comprising a player actuated key, a vibratory tine mounted to be struck and set into vibration in response to pressing of said key, transducer means for sensing vibration of said tine and generating a piano voice signal, means for converting said signal into sound, means responsive to the vibration of said tine, as transduced by said transducer means, for generating a control signal having an amplitude envelope that corresponds to the amplitude envelope of said piano voice signal, an auxiliary tone generator for generating an electronic tone signal, modulator means responsive to said control signal generating means and to said auxiliary tone generator for impressing the amplitude envelope of said control signal upon said electronic tone signal to provide an amplitude modulated electronic tone signal, said modulator means comprising clipping diode means connected to be responsive to said control signal and to said electronic tone signal for amplitude modulating said electronic tone signal in response to said control signal, an operational amplifier responsive to said control signal for overcoming the conduction threshold of said diode means, and means for combining said modulated electronic tone signal with said piano voice signal prior to conversion of said piano voice signal to sound.

2. An electric piano comprising a player actuated key, a vibratory tine mounted to be struck and set into vibration in response to pressing of said key, transducer means for sensing vibration of said tine and generating a piano voice signal, means for converting said signal into sound, means responsive to said transducer means for generating a control signal having an amplitude that corresponds to the amplitude of said piano voice signal, an auxiliary tone generator for generating an electronic voice signal, an operational amplifier having inverting and non-inverting inputs and having an output, means for feeding said control signal and said electronic voice signal to at least one of said amplifier inputs, means for providing a first unidirectionally conducting feedback path of a first polarity between said amplifier output and an input of said amplifier, means for providing a second unidirectionally conducting path of opposite polarity between said amplifier output and an input thereof, means for providing an amplitude modulated electronic voice signal as a modulator output from one of said feedback paths, and means interposed between said transducer means and said converting means for combining said piano voice signal with said amplitude modulated electronic voice signal provided at said modulator output.

3. The piano of claim 2 wherein said first feedback path comprises a series connected diode and resistor, said modulator output being provided at a junction of said diode and resistor, and wherein said second feedback path comprises a diode connected directly between said amplifier output and said one input.

4. The piano of claim 2 including means for reverse biasing said first mentioned diode to decrease signal at said modulator output in the absence of input signal to said amplifier.

5. The piano of claim 4 wherein said means for reverse biasing said first diode comprises means for providing a bias voltage to an input of said operational amplifier.

6. The piano of claim 2 including means for differentially combining said piano voice signal and said electronic voice signal and wherein said feedback paths have mutually opposite polarities.

7. The piano of claim 6 wherein said means for differentially combining comprises means for feeding said piano voice signal and said electronic voice signal to one of said amplifier inputs with mutually opposite polarities.

8. A multi-voice electric piano comprising keyboard means including a vibratory tone-generating tine for percussively and electromagnetically generating a piano voice signal having an amplitude envelope embodying touch dynamics of said keyboard means, electronic means for generating an electronic voice signal, means responsive to said piano voice signal for gating and modulating said electronic voice signal to provide a piano modulated electronic voice signal having an amplitude envelope embodying touch dynamics of said keyboard means, means for converting voice signals to sound, and means responsive to said modulated electronic voice signal and said piano voice signal for transmitting to said converting means both said piano voice signal and said modulated electronic voice signal together, said means for gating and modulating comprising an amplifier having first and second undirectional feedback circuits, and means for differentially feeding said piano and electronic voice signals to said amplifier, one of said feedback circuits providing said modulated electronic voice signal.

9. The piano of claim 8 wherein said feedback circuits respectively include first and second diodes, said diodes and amplifier inputs being relatively poled to cause said first circuit to uniquely pass an output signal component of said amplifier caused by said piano voice signal, and to cause said second circuit to uniquely pass an output signal component of said amplifier caused by said electronic voice signal.

10. The piano of claim 8 wherein said amplifier has inverting and non-inverting inputs, and wherein said piano and electronic voice signals are fed with mutually opposite polarity to one of said amplifier inputs.

11. The piano of claim 8 wherein said amplifier has inverting and non-inverting inputs, wherein said piano and electronic voice signals are fed with like polarity to respective ones of said inputs.

12. In combination with a multi-voice electrical keyboard instrument having keyboard actuated means including a vibratory tone-generating tine for electromechanically generating a piano voice signal, electronic means for generating an electronic voice signal, and means for simultaneously feeding said signals to a loudspeaker, a gating modulator for gating and modulating said electronic voice signal, said modulator comprising an amplifier having an output and input, means for feeding said signals to said amplifier input, means for providing a first feedback path of one polarity from output to input of said amplifier, means for providing a second feedback path of opposite polarity from output to input of said amplifier, and means for providing a modulator output from one of said paths for transmission to a loudspeaker.

13. The apparatus of claim 12 wherein said modulator output is provided from said first path.

14. The apparatus of claim 12 wherein said means for providing feedback paths comprise unidirectional conducting means poled for uniquely conducting signals of opposite polarities from output to input of said amplifier.

15. The apparatus of claim 12 wherein said electronic voice signal tends to cause signal amplitude variations at said amplifier output, and including means for decreasing amplitude of said variations.

16. The apparatus of claim 12 wherein said second feedback path has a low impedance whereby the output of said amplifier that is caused by said electronic voice signal has a relatively small amplitude, and wherein said first feedback path has a relatively high impedance, whereby the output of said amplifier caused by said piano voice signal has a relatively large amplitude.

17. The apparatus of claim 12 including means for blocking said modulator output in the absence of both said electronic and piano voice signals.

18. The apparatus of claim 17 wherein said first feedback path includes a series connected diode and resistor, and wherein said means for blocking comprises means for reverse biasing said diode.

19. The apparatus of claim 12 wherein said amplifier has inverting and non-inverting inputs, and wherein said piano voice signal is modified, said modified piano and electronic voice signals being fed with mutually opposite polarities to a first one of said inputs, said first feedback path having a relatively high resistance and including a first diode poled to pass a component of the output of said amplifier caused by said modified piano voice signal, said second feedback path having a relatively low resistance and including a second diode poled to pass a component of the output of said amplifier caused by said electronic voice signal, said modulator output being provided from said first feedback path.

20. The apparatus of claim 19 including means coupled to the other of said amplifier inputs for reverse biasing said first diode.

21. The method of generating music comprising percussively initiating vibration of a vibratory tine at a fundamental frequency and overtones thereof, transducing vibration of said tine to a primary electrical signal of said fundamental and overtone frequencies and having an amplitude envelope corresponding to the amplitude envelope of vibration of said tine, converting said signal to sound, electronically generating an auxiliary electrical signal having an amplitude envelope corresponding to the amplitude envelope of said primary electrical signal, and having a duration corresponding to the duration of vibration of said tine, said step of electronically generating comprising producing a control signal having an amplitude envelope corresponding to the amplitude envelope of said primary signal, differentially feeding an electronically generated signal and said control signal to an amplifier input to produce an output therefrom, feeding said output back to said input through first and second unidirectional feedback paths of mutually opposite polarity, and providing said auxiliary signal at a point in one of said feedback paths, and combining said auxiliary signal with said primary signal before the latter is converted to sound.

* * * * *